United States Patent [19]

Klann

[11] Patent Number: 4,615,254

[45] Date of Patent: Oct. 7, 1986

[54] ORGAN DRAWKNOB

[76] Inventor: Paul A. Klann, P.O. Box 2398, Waynesboro, Va. 22980

[21] Appl. No.: 768,527

[22] Filed: Aug. 22, 1985

[51] Int. Cl.[4] ..... G10B 3/10

[52] U.S. Cl. ..... 84/343; 84/369

[58] Field of Search ..... 84/85, 343, 369–371

[56] References Cited

U.S. PATENT DOCUMENTS

| | | | |
|---|---|---|---|
| 474,881 | 5/1892 | Trainer | 84/369 |
| 605,404 | 6/1898 | Davis | 84/369 |
| 1,659,914 | 2/1928 | Haskell | 84/85 |
| 4,157,051 | 6/1979 | Peterson et al. | 84/343 |

FOREIGN PATENT DOCUMENTS

| | | | |
|---|---|---|---|
| 416071 | 9/1934 | United Kingdom | 84/343 |

*Primary Examiner*—Lawrence R. Franklin

*Attorney, Agent, or Firm*—Sughrue, Mion, Zinn, Macpeak & Seas

[57] ABSTRACT

A drawknob for an organ is slidably mounted in an organ panel with one end thereof illuminated to indicate the state of the drawknob. A plate member is pivotally mounted relative to the other end of the drawknob and a spring device is provided for normally maintaining the plate member perpendicular to the longitudinal axis of the drawknob. One or more magnets are mounted on the plate member which are disposed between two magnetically operated switches. A restraint is provided adjacent the periphery of the plate member so that upon reciprocating movement of the drawknob in opposite directions the plate member will be pivoted to bring a magnet thereon into close proximity with one of the magnetically operated switches to operate the same.

4 Claims, 7 Drawing Figures

FIG. 1a
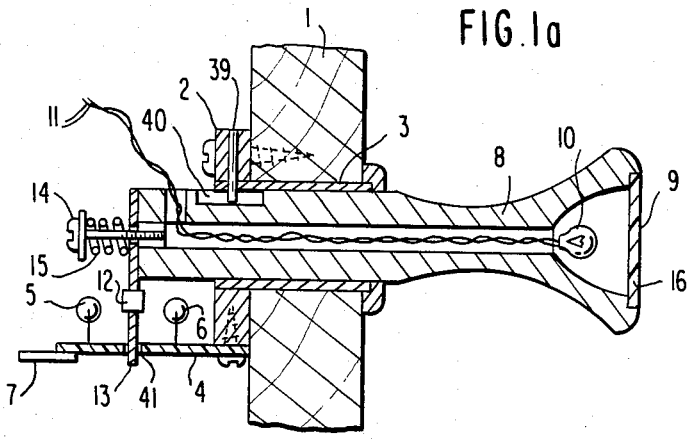
FIG. 1b
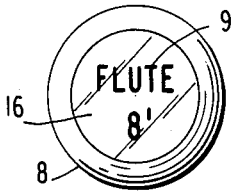
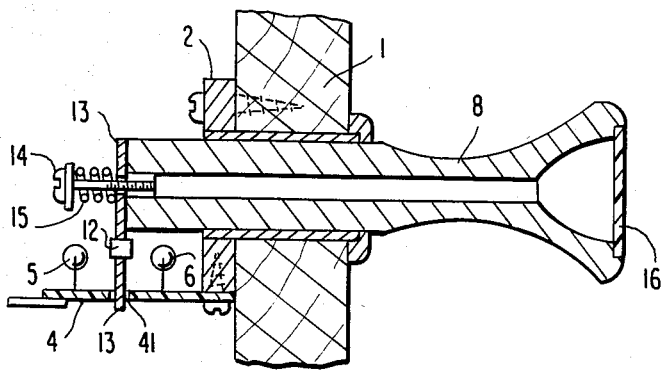
FIG. 2
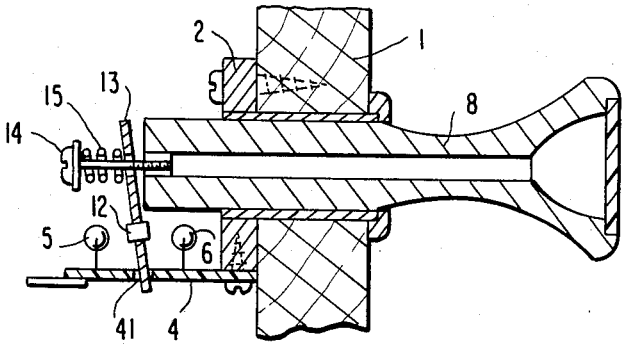
FIG. 3
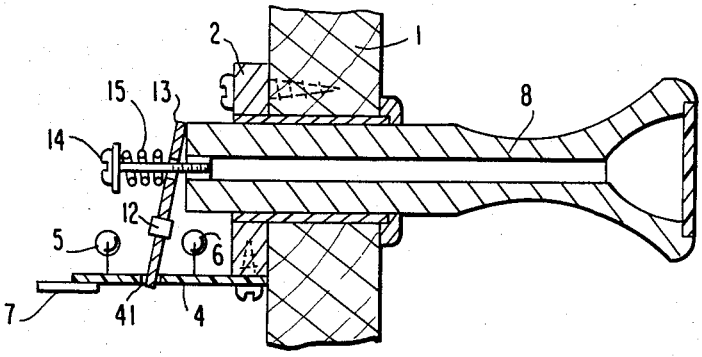
FIG. 4

ORGAN DRAWKNOB

BACKGROUND OF THE INVENTION

The present invention is directed to an organ drawknob for use with either a pipe organ or an electronic organ which permits an organist to select a rank of pipes or sound generating devices which are to be played from a given keyboard and more specifically to an organ drawknob having specific return means and indicator means to enable the organist to determine the state of the drawknob.

Organ drawknobs are old and well known in the art and were first used in conjunction with pipe organs. An organ drawknob allows an organist to select the rank of pipes which is to be played from a given key board. If a set of pipes can be heard upon playing a given keyboard, the corresponding drawknob for that pipe is in the ON state. If that set of pipes cannot be heard then the drawknob is known to be in the OFF state. At all times the organist must know if a set of pipes will play or not as the organist plays from a particular keyboard. Indication as to whether or not the drawknob is in the ON or OFF state can be determined either by the physical position of the drawknob or by means of an indicator light. Very often the indicator light is located inside the drawknob and when ON will back illuminate the lettering on the face of the drawknob. Thus when the drawknob is pulled outwardly an electrical contact will be made which turns on the indicator lighta and the contact will remain closed until the drawknob is pushed inwardly by the organist.

SUMMARY OF THE INVENTION

The present invention provides a new and improved organ drawknob which is pulled outwardly momentarily to initiate the ON state and pushed inwardly momentarily to initiate the OFF state but in each instance the drawknob will immediately be returned to a neutral position remote from the electrical contacts controlling the ON and OFF state.

The present invention provides a new and improved organ drawknob comprising bushing means for slidably guiding the drawknob inwardly and outwardly relative to an aperture in the support panel, electrical illuminating means disposed within said drawknob, a printed circuit board secured to said support panel and having a pair of spaced apart magnetically operated reed switches electrically connected thereto and an aperture located between said reed switches, plate means pivotally mounted on the innermost end of said drawknob, resilient means normally biasing said plate means into a position perpendicular to the axis of said drawknob with an outwardly extending portion of said plate means engaging in said aperture in said printed circuit board and magnetic means mounted on said plate means intermediate said reed switches whereby sliding movement of said drawknob in opposite directions in said bushing will cause pivotal movement of said plate means to bring said magnetic means into close proximity with a respective reed switch and actuate the same and upon release of the drawknob said resilient means will return said drawknob and said plate means to an intermediate position with said magnetic means being inoperatively spaced between said switches.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1*a* is a sectional side elevational view of a drawknob according to the present invention.

FIG. 1*b* is an end view of the drawknob shown in FIG. 1*a*.

FIG. 2 is a view similar to FIG. 1 showing the drawknob in the intermediate position.

FIG. 3 is a view similar to FIG. 2 showing the drawknob pushed inwardly to energize one of the reed switches.

FIG. 4 is a view similar to FIG. 2 with the drawknob pulled outwardly to energize the other of the reed switches.

DETAILED DESCRIPTION OF THE INVENTION

Figure 5:
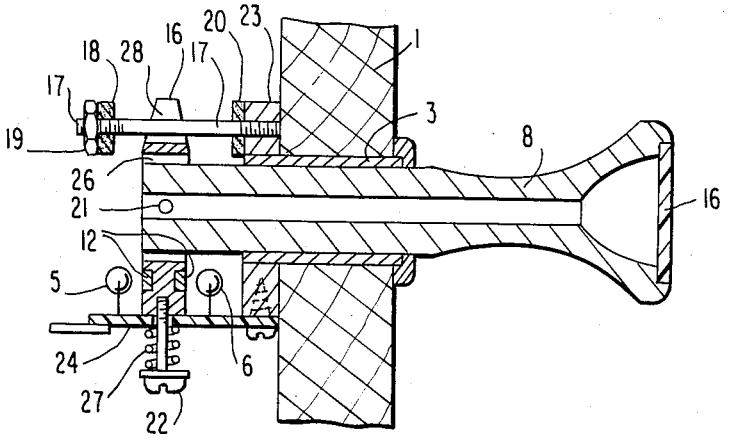
FIG. 5 is a side elevation view similar to FIG. 1 showing a modified construction of the switch actuating mechanism associated with the drawknob.

In a first embodiment of an organ drawknob according to the present invention as shown in FIGS. 1–4, inclusive, the drawknob 8 is slidably mounted for reciprocating movement in bushing 3 located within a cylindrical aperture in the support panel 1 which forms part of the organ housing. The drawknob 8 is provided with a substantially hollow head portion having a lamp 10 located therein which is closed by a translucent plate 16 having identifying indicia 9 engraved or otherwise suitably applied thereto. The wires 11 for the lamp 10 extend through a hollow central passage in the drawknob and exit therefrom on the opposite side of the support panel 1 from the head of the drawknob.

The inner end of the bushing 3 has an annular support ring 2 integrally secured thereto by any suitable means with the ring 2 being secured to the support panel 1 by screws or the like. A radially directed pin 9 is secured in an aperture in the support ring 2 and extends into a longitudinal groove 40 formed in the drawknob 8 to keep the drawknob 8 from rotating about its own axis while permitting reciprocating movement with the bushing 3. The printed circuit board 4 is also secured to the support ring 2 by screws or any other suitable means and is provided with a plurality of electrical connectors 7. A pair of magnetically operable reed switches 5 and 6 are electrically connected to the circuit on the printed circuit board and extend outwardly in spaced relation to the printed circuit board 4. The wires 11 from the lamp 10 are also connected to the printed circuit board but the specific connection and details of the electronic circuitry are not shown since they are not necessary for an understanding of the present invention.

A plate 13 is moveably mounted on the innermost end of the drawknob 8 by means of a screw 14 which passes freely through an aperture in the plate 13 and is threaded into a plug secured in the end of the drawknob. A spring 15 surrounds the shank of the screw 14 and normally biases the plate into flat engagement with the end surface of the drawknob 8 so that the plate 13 normally extends perpendicular to the axis of the drawknob 8. A magnet 12 is secured in an aperture in the plate 13 and is disclosed intermediate the two reed switches 5 and 6. The end of the plate 13 which extends outwardly from the drawknob 8 is located in a slot 41 in the printed circuit board 4.

When it is desired to select a particular rank of pipes the specific drawknob 8 is pulled outwardly from the neutral or intermediate position illustrated in FIG. 2 so that the plate 13 will pivot about the aperture in the printed circuit board 4 against the force of the spring 15. Such a pivoting action of the plate 13 will bring the magnet 12 carried thereon into close proximity with the magnetically operated reed switch 6 thereby closing the circuit to illuminate the lamp 10. The electronic circuitry is provided with a conventional holding circuit so that it is only necessary to momentarily pull the drawknob outwardly to initiate energization of the lamp 10. Upon release of the drawknob 8 the spring 15 will restore the plate 13 to the neutral position as shown in FIG. 2 and the lamp 10 will remain ON to indicate that the rank of pipes or sound generators associated with that drawknob are in the ON condition and will be heard upon playing the appropriate keyboard. When it is desired to discontinue the operation of the selected rank of pipes or sound generators it is only necessary to momentarily press the drawknob 8 inwardly whereby the plate 13 will pivot in the opposite direction of the aperture 41 in the printed circuit board 4 to bring the magnet 12 carried by the plate 13 into close proximity to the magnetically operable reed switch 5 to close the contacts associated therewith. The electronic circuitry will then prevent the corresponding set of pipes or sound generators from being heard and the circuit to the lamp 10 will be broken to indicate that that particular drawknob is in the OFF position.

In the embodiment of FIG. 5 the drawknob 8 is identical to the drawknob 8 in the previous embodiment but the lamp 10 and lead wires 11 have not been illustrated. A guide sleeve 3 is provided in a cylindrical aperture in the panel 1 with the innermost end being secured in a support plate 23 which is secured to the panel 1 by means of screws 23'. As in the previous embodiment a printed circuit board 24 is secured to the support plate 23 by means of screws or the like with the printed circuit board extending parallel to the longitudinal axis of the drawknob 8. An activating plate 16 is provided with a cylindrical aperture 26 having a diameter slightly larger than the diameter of the drawknob 8 and the plate 16 is pivotally mounted on the inner end of the drawknob 8 by means of a pivot 21.

A pair of magnetically operated reed switches 5 and 6 are mounted on the printed circuit board 24 and extend parallel to each other on opposite sides of the activating plate 16. A pair of magnets 12 are carried by opposite faces of the activating plate 16 in alignment with the reed switches 5 and 6 respectively. The activating plate 16 is loosely pivoted on the printed circuit board 12 by means of a screw 22 which extends through an enlarged aperture in the printed circuit board with the innermost end of the screw 22 being in threaded engagement with the lower edge of the plate 16. A spring 27 surrounds the screw 22 between the head of the screw and the printed circuit board 24 so as to normally bias the plate 16 into a perpendicular position relative to the printed circuit board 24 as shown in FIG. 5.

The upper edge of the activating plate 16 is provided with a notch 28 which slidably receives a pin 17 having threads on opposite ends thereof. One end of the pin 17 is threaded into engagement with the support plate 23 with a felt stop 20 surrounding the pin 17 in engagement with the support plate 23. A second felt stop 18 is secured to the opposite threaded end of the pin 17 and is held thereon by means of a securing nut 19.

Figure 6:
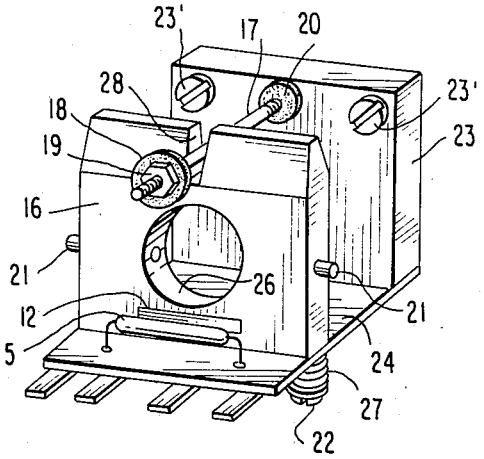
FIG. 6 is a perspective view of the arrangement shown in FIG. 5.

In the operation of the embodiment of FIGS. 5 and 6, if the drawknob 8 is pulled outwardly momentarily the plate 16 will be pivoted about the pivot pins 21 in a clockwise direction as viewed in FIG. 5 so as to bring the magnet 12 adjacent the reed switch 6 into close proximity with the reed switch 6 in order to close the contact thereof in order to energize the lamp within the head of the drawknob to indicate an ON condition. Upon release of the drawknob 8 the spring 27 will return the plate 16 to the position shown in FIG. 5 and a holding circuit will maintain the lamp in the lighted position. Upon momentary depression of the drawknob 8 inwardly the plate 16 will be pivoted in the counterclockwise direction as viewed in FIG. 5 to bring the magnet thereon adjacent the reed switch 5 into close proximity with the reed switch in order to close the contacts thereof. The closing of the contacts of the switch 5 will operate through suitable electronic circuitry to turn the lamp OFF so that the organist will be able to determine that the particular rank of pipes or sound generators controlled by this drawknob is in the OFF condition.

While the invention has been particularly shown and described with reference to preferred embodiments thereof, it will be understood by those in the art that the foregoing and other changes in form and detail may be made therein without departing from the spirit and scope of the invention.

What is claimed is:

1. A drawknob for an organ comprising support means adapted to be secured to an organ panel for slidably mounting a drawknob extending through an aperture in said panel, illumination means disposed in one end of said drawknob, plate means moveably mounted on the other end of said drawknob, a pair of magnetically operable switch means mounted on said support means on opposite sides of said plate means, magnet means mounted on said plate means intermediate said switch means, interengageable means on said plate means and support means for pivoting said plate means relative to said drawknob as said drawknob is pushed or pulled relative to said panel to bring said magnet means into close proximity with one of said switch means for operating said one of said switch means and spring means operably associated with said plate means for returning said plate means to a non-switch operating position intermediate said pair of switch means.

2. A drawknob as set forth in claim 1 wherein said support means is comprised of a sleeve adapted to extend through a cylindrical aperture in said panel, a support member secured to the inner end of said sleeve and surrounding said drawknob and printed circuit means secured to said support member, said printed circuit means extending parallel to the longitudinal axis of said drawknob and having said switch means mounted thereon intermediate said printed circuit means and said drawknob.

3. A drawknob as set forth in claim 2 further comprising spring means normally supporting said plate means against said other end of said drawknob perpendicular to the longitudinal axis thereof and wherein said interengageable means is comprised of aperture means in said printed circuit means midway between said switchh means and means on said plate means loosely engageable in said aperture means.

4. A drawknob as set forth in claim 2 wherein said interengageable means is comprised of aperture means in said printed circuit means spaced equidistantly from said switch means, projection means on said plate means extending through said aperture means and spring means engageable with said projection means and said printed circuit means for normally maintaining said plate means perpendicular to said printed circuit means intermediate said switch means and further comprising pivot means disposed transversely to the longitudinal axis of said drawknob for pivotally mounting said plate means on said drawknob and limit means engageable with opposite sides of said plate means for limiting pivotal movement of said plate means upon movement of said drawknob in opposite directions.

* * * * *